US005947025A

United States Patent [19]

Huang

[11] Patent Number: 5,947,025

[45] Date of Patent: Sep. 7, 1999

[54] TAPE DISPENSER CAPABLE OF PRINTING PATTERNS AND WORDS ON TAPE DISPENSED THEREBY

[76] Inventor: Harrison Huang, No. 23, Lin T'So Rd., Shengkang, Taichung Shien, Taiwan

[21] Appl. No.: 09/075,850

[22] Filed: May 12, 1998

[51] Int. Cl.[6] ..... B41K 1/00

[52] U.S. Cl. ..... 101/327; 101/288; 101/351.2; 101/352.03

[58] Field of Search ..... 101/288, 351.1, 101/351.2, 351.3, 352.01, 352.02, 352.03, 352.04, 327

[56] References Cited

U.S. PATENT DOCUMENTS

| | | | |
|---|---|---|---|
| 2,223,907 | 12/1940 | Bronfman | 101/226 |
| 2,323,976 | 7/1943 | Chalmers | 101/216 |
| 2,432,202 | 12/1947 | Mason | 101/227 |
| 2,511,856 | 6/1950 | Kendall | 101/328 |
| 2,598,892 | 6/1952 | Critchlow, Jr. et al. | 101/227 |
| 4,290,840 | 9/1981 | Pabodie et al. | 101/288 |
| 4,359,939 | 11/1982 | Sato | 101/288 |
| 4,411,197 | 10/1983 | Sato | 101/288 |
| 4,800,812 | 1/1989 | Lin | 101/288 |
| 5,197,386 | 3/1993 | Lin | 101/213 |
| 5,784,959 | 7/1998 | Larios | 101/219 |

*Primary Examiner*—Edgar Burr
*Assistant Examiner*—Leslie J. Grohusky
*Attorney, Agent, or Firm*—Browdy and Neimark

[57] ABSTRACT

A tape dispenser is capable of printing patterns and words on the tape dispensed thereby and is composed of a main body, a tape roll holding portion mounted on the main body, a printing wheel fastened pivotally with the main body, an ink supplying device fastened with the main body such that the ink supplying device is capable of inking a printing plate of the printing wheel, and a tape cutter for severing the tape.

12 Claims, 3 Drawing Sheets

TAPE DISPENSER CAPABLE OF PRINTING PATTERNS AND WORDS ON TAPE DISPENSED THEREBY

FIELD OF THE INVENTION

The present invention relates generally to a tape dispenser, and more particularly to a tape dispenser capable of printing the tape which is dispensed by the tape dispenser.

BACKGROUND OF THE INVENTION

The conventional adhesive tapes are widely used for packaging and are often printed with various patterns, words, logos, etc. The conventional tape dispensers are not equipped to print the tapes which they dispense. As a result, the tapes must be printed separately in a special order, which is rather expensive.

SUMMARY OF THE INVENTION

The primary objective of the present invention is therefore to provide a tape dispenser with means capable of printing the tape dispensed by the tape dispenser.

In keeping with the principle of the present invention, the foregoing objective of the present invention is attained by a tape dispenser consisting of a main body for mounting rotatably a tape roll, a printing wheel fastened pivotally with the main body, an ink supplying device fastened with the main body such that the ink supplying device is capable of inking a printing plate of the printing wheel, and a tape cutter fastened with the main body for severing the tape.

The forgoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
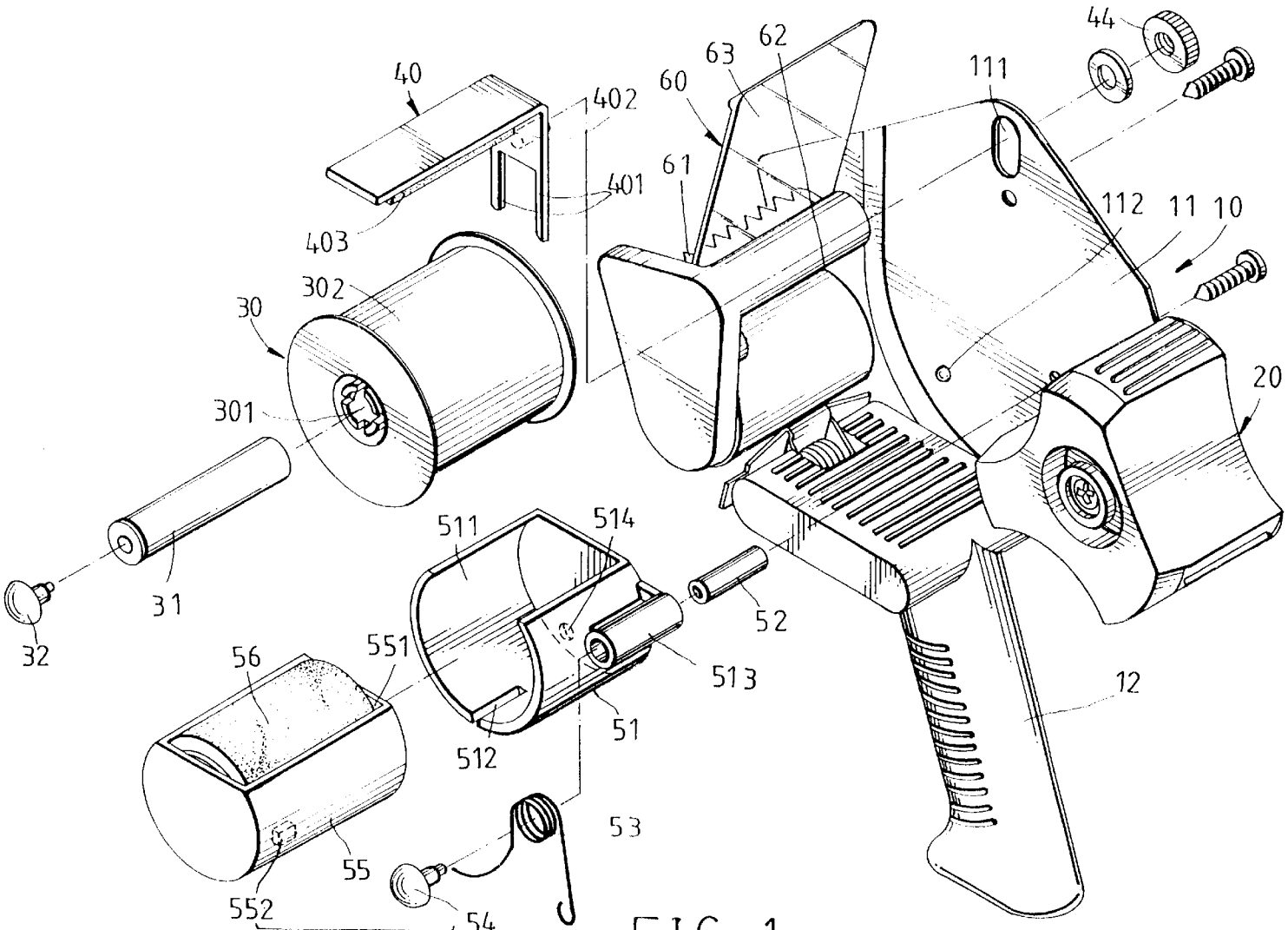
FIG. 1 shows a partial exploded view of a preferred embodiment of the present invention.

As shown in FIGS. 1–4, a tape dispenser embodied in the present invention is composed of a main body 10, a tape roll holding portion 20, a printing wheel 30, a press member 40, an ink supplying device 50, and a tape cutter 60.

The main body 10 consists of a base plate 11 and a hand grip 12 fastened with one side of the bottom of the base plate 11. The base plate 11 is provided at the top thereof with a slot 111, a knob 112, and a warp hook 113 shown in FIGS. 2 and 4.

The tape roll holding portion 20 is fastened pivotally with a three-branched rotary wheel (a prior art structure) for holding an adhesive tape of a specific size. The rotary wheel comes in various sizes for accommodating the adhesive tapes of various sizes.

The printing wheel 30 of a cylindrical construction is provided at the center thereof with an axial hole 301, and in the periphery thereof with a printing plate 302 having patterns and words formed thereon. The patterns and the words are formed in normal image instead of mirror image. A first shaft 31 is fastened with the base plate 11 such that the first shaft 31 is located under the slot 111. The axial hole 301 of the printing wheel 30 is fitted over the first shaft 31. The printing wheel 30 is prevented from slipping out by an arresting member 32 which is inserted into an outer end of the first shaft 31.

The press member 40 of an L-shaped construction is provided at one end thereof with two holding strips 401 and a threaded rod 402 extending outwards. The press member 40 is further provided in the inner side of another end thereof with a soft pad 403 capable of being caused by the press member 40 to face the top side of the circumference of the printing wheel 30. The two holding strips 401 are attached to two sides of the first shaft 31. The threaded rod 402 is movably attached to the base plate 11 via the slot 111 of the base plate 11 and is fastened with a nutlike rotary button 44 from the outer side of the base plate 11 for fastening securely the press member 40.

Figure 3:
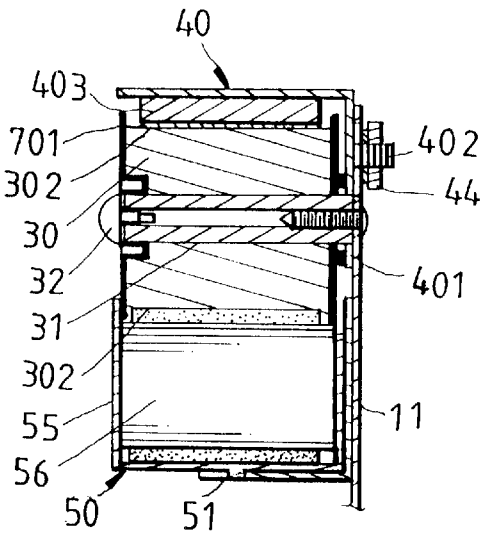
FIG. 3 shows a sectional view of a portion taken along the direction indicated by a line 3—3 as shown in FIG. 2.
Figure 2:
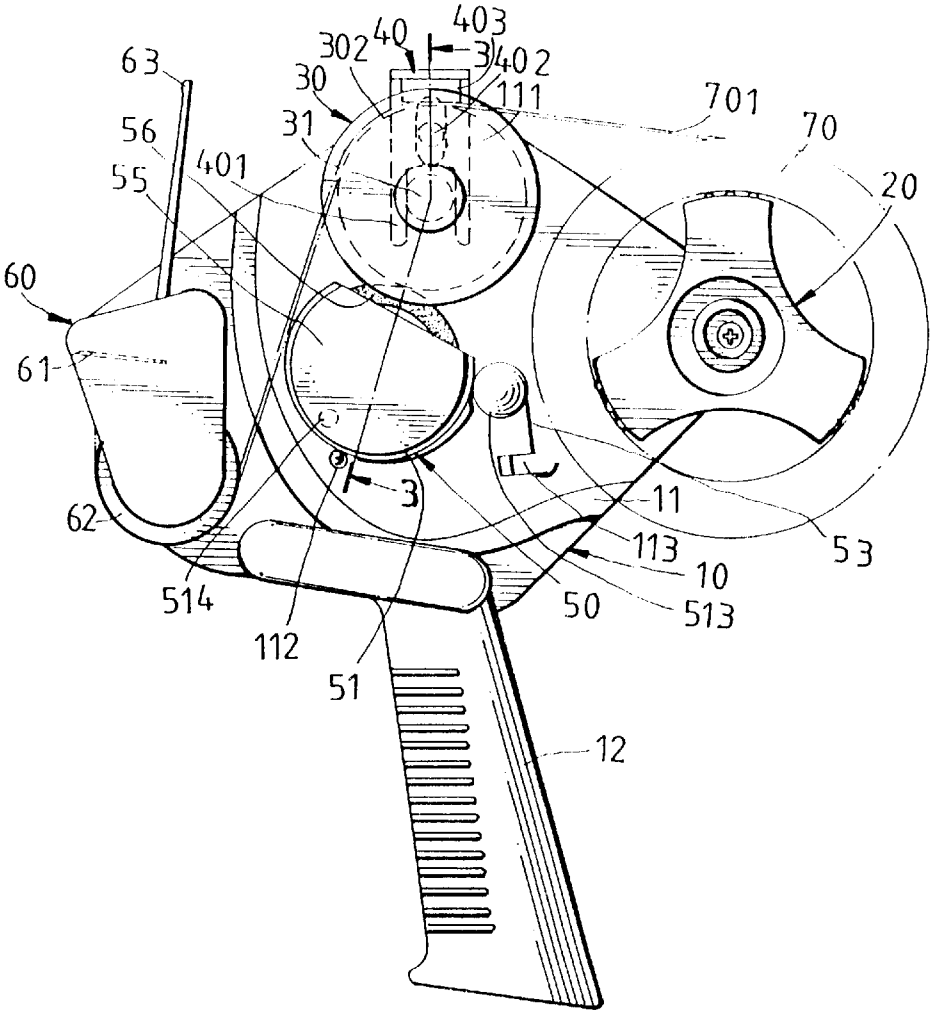
FIG. 2 shows a side view of the preferred embodiment of the present invention, with the ink supplying device being located at the first position (in the state of operation).
Figure 4:
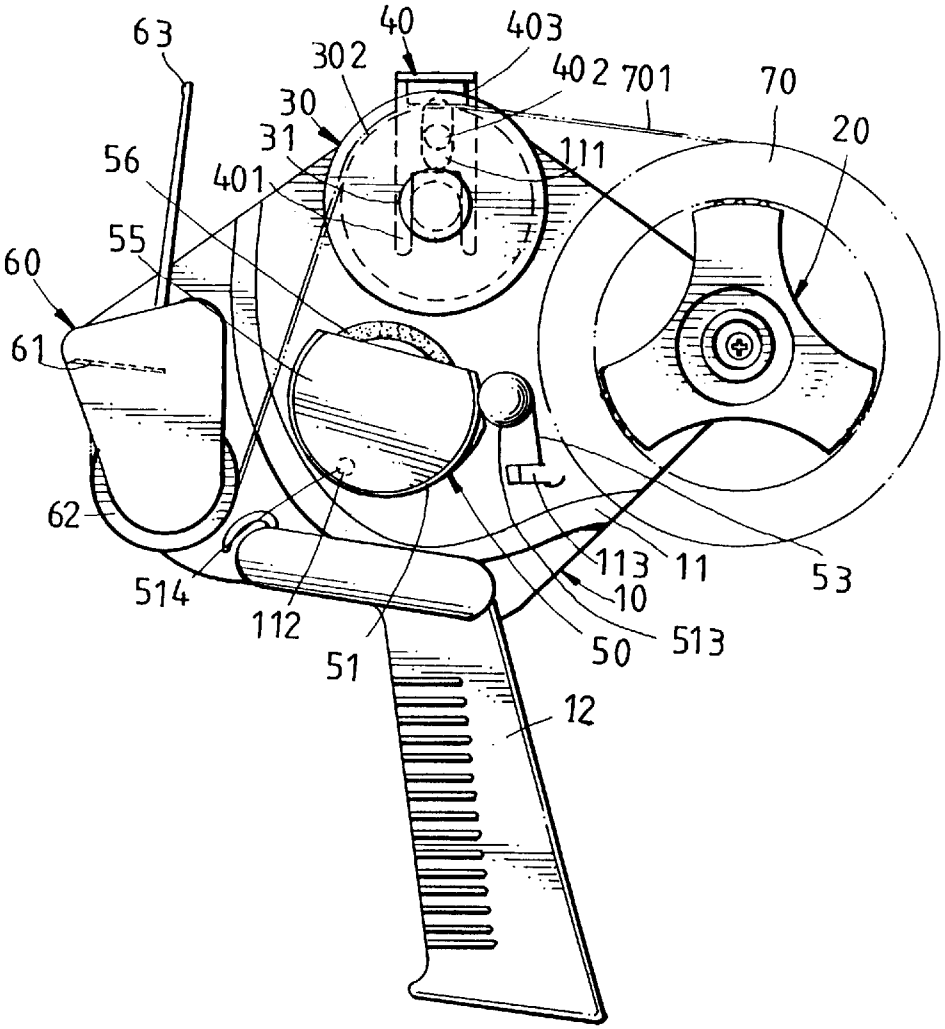
FIG. 4 shows a side view of the preferred embodiment of the present invention, with the ink supplying device being located at the second position (on standby).

The ink supplying device 50 consists of a seat 51 of a cup-shaped construction and provided in one side of the periphery thereof with a cut 511. Located in another side opposite to the one side of the seat 51 is a locating slot 512. The seat 51 is further provided in the outer side of the periphery thereof with a shaft tube 513. The seat 51 is further provided with a retaining hole 514. A second shaft 52 is fastened with the base plate 11. The shaft tube 513 of the seat 51 is fitted over the second shaft 52. A torsion spring 53 is fitted over the shaft tube 513 of the seat 51. An arresting member 54 is inserted into the outer end of the second shaft 52 to prevent the torsion spring 53 from slipping out. The torsion spring 53 has one end urging the outer peripheral surface of the seat, with another end of the torsion spring 53 being engaged with the warp hook 113 of the base plate 11 such that the seat 51 is forced to turn in a direction. An ink storage cassette 55 of a hollow cylindrical construction is provided with an exposure port 551, a rib 552, and a rollerlike ink soaking member 56 fastened pivotally therewith such that the ink soaking member 56 is capable of extending out via the exposure port 551. The ink storage cassette 55 is inserted into the seat 51 such that the rib 552 is corresponding in location to the locating slot 512 of the seat 51, and that the ink soaking member 56 is exposed at one side of the cut 511 of the seat 51. The seat 51 of the ink supplying device 50 is capable of being retained at a first position as shown in FIG. 2, or a second position as shown in FIG. 4. When the seat 51 is retained at the first position, the seat 51 is urged by the torsion spring 53 so as to cause the ink soaking member 56 to be in contact with the printing plate 302 of the printing wheel 30, as shown in FIG. 3. When the ink supplying device 50 is located at the second position, the knob 112 is retained in the retaining hole 514 of the seat 51 so as to resist the pushing force of the torsion spring 53. The ink soaking member 56 is thus kept a distance away from the printing wheel 30.

The tape cutter 60 is fastened with the front end of the base plate 11 and is composed of a toothed blade 61, a roller 62, and a stopping piece 63.

As illustrated in FIGS. 2–4, a transparent tape roll 70 is fitted with the tape roll holding portion 20 such that a tape 701 of the tape roll 70 is pulled out to let the adhesive underside of the tape 701 attach to the printing plate 302 of the printing wheel 30 before reaching the blade 61 through the roller 62 of the cutter 60. The tape 701 can be pressed tight by the soft pad 403 of the press member 40 before the rotary button 44 is tightened to make sure that the tape 701 is in a proper contact with the printing plate 302. In operation, the ink supplying device 50 is moved to the first position, as shown in FIGS. 2 and 3, such that the ink soaking member 56 is in contact with the bottom side of the printing wheel 30. As the tape 701 is dispensed, the printing wheel 30 is actuated to turn such that the ink soaking member 56 is actuated to turn so as to wet the printing plate 302 with the ink to facilitate the printing of patterns or words on the tape 701 being dispensed.

When the ink soaking member 56 of the ink supplying device 50 is dry, the seat 51 is first moved to the second position, as shown in FIG. 4, before the ink storage cassette 55 is taken out to wet the ink soaking member 56 with ink. The ink storage cassette 55 is then put back into the seat 51. A plurality of ink storage cassettes may be provided for keeping inks of various colors to facilitate the printing of the tape 701 with patterns or words in various colors.

In the event that the printing of the tape 701 is not called for, the ink supplying device 50 can be temporarily disabled by moving the ink supplying device 50 to the second position.

What is claimed is:

1. A tape dispenser capable of printing patterns or words on a tape dispensed thereby, said tape dispenser comprising:

a main body;

a tape roll holding portion mounted on said main body to hold a tape roll such that the tape roll can be turned;

a printing wheel fastened pivotally with said main body and provided on a periphery thereof with a printing plate;

an ink supply device fastened with said main body and provided with an ink soaking member capable of making contact with said periphery of said printing wheel so as to wet said printing plate with ink;

a tape cutter fastened with said main body for severing the tape;

wherein said ink supplying device is fastened with said main body such that said ink supplying device is capable of being switched from a first position to a second position and vice versa, and that said ink soaking member is in contact with said periphery of said printing wheel at such time when said ink supplying device is located at said first position, and further that said ink soaking member is kept a distance away from said periphery of said printing wheel at such time when said ink supplying device is located at said second position; and wherein said ink supplying device has a seat and an ink storage cassette inserted into said seat which is fastened pivotally with said main body such that said seat is capable of being switched from said first position to said second position and vice versa; wherein said ink soaking member is fastened pivotally in said ink storage cassette; and wherein said ink storage cassette can be removed from said seat at the time when said seat is located at said second position.

2. The tape dispenser as defined in claim 1 further comprising a press member fastened with said main body such that said press member is capable of pressing a tape evenly on said printing plate of said printing wheel.

3. The tape dispenser as defined in claim 1, wherein said main body is composed of a base plate which is provided at one end thereof with a hand grip; and wherein said tape roll holding portion, said printing wheel, said ink supplying device and said tape cutter are fastened on said base plate.

4. The tape dispenser as defined in claim 1, wherein said printing plate of said printing wheel is provided thereon with patterns or words.

5. A tape dispenser capable of printing patterns or words on a tape dispensed thereby, said tape dispenser comprising:

a main body;

a tape roll holding portion mounted on said main body to hold a tape roll such that the tape roll can be turned;

a printing wheel fastened pivotally with said main body and provided on a periphery thereof with a printing plate;

an ink supplying device fastened with said main body and provided with an ink soaking member capable of making contact with said periphery of said printing wheel so as to wet said printing plate with ink;

a tape cutter fastened with said main body for severing the tape;

wherein said ink supplying device has a seat and an ink storage cassette and is fastened with said main body such that said ink supplying device is capable of being switched from a first position to a second position and vice versa, and that said ink soaking member is in contact with said periphery of said printing wheel at such time when said ink supplying device is located at said first position, and further that said ink soaking member is kept a distance away from said periphery of said printing wheel at such time when said ink supplying device is located at said second position; and wherein said main body is provided with a shaft and a knob contiguous to said shaft; wherein said seat of said ink supplying device has a cup-shaped construction and is provided in a periphery thereof with a cut, a locating slot, and a shaft tube having a retaining hole; said seat being mounted on said shaft such that said shaft tube is engaged with said shaft, and that said seat is capable of turning between said first position and said second position; said shaft tube being fitted into a torsion spring which has one end urging said seat and another end fastened with said main body for urging said seat to move toward said first position; wherein said ink storage cassette of said ink supplying device has a hollow cylindrical construction and provided in a periphery thereof with a rib corresponding in location to said locating slot of said seat, and an exposure port corresponding in location to said cut; wherein said ink soaking member has a roller construction and is fastened pivotally in said ink storage cassette such that said ink soaking member is rotatably exposed via said exposure port; and wherein said knob of said main body is retained in said retaining hole of said seat at such time when said seat is located at said second position.

6. The tape dispenser as defined in claim 5, further comprising a press member fastened with said main body such that said press member is capable of pressing a tape evenly on said printing plate of said printing wheel.

7. The tape dispenser as defined in claim 5, wherein said main body is composed of a base plate which is provided at one end thereof with a hand grip; and wherein said tape roll holding portion, said printing wheel, said ink supplying device and said tape cutter are fastened on said base plate.

8. The tape dispenser as defined in claim 5, wherein said printing plate of said printing wheel is provided thereon with patterns or words.

9. A tape dispenser capable of printing patterns or words on a tape roll dispensed thereby, said tape dispenser comprising:

a main body;

a tape roll holding portion mounted on said main body to hold a tape roll such that the tape roll can be turned;

a printing wheel fastened pivotally with said main body and provided on a periphery thereof with a printing plate;

an ink supplying device fastened with said main body and provided with an ink soaking member capable of making contact with said periphery of said printing wheel so as to wet said printing plate with ink;

a tape cutter fastened with said main body for severing the tape;

wherein said ink supplying device is fastened with said main body such that said ink supplying device is capable of being switched from a first position to a second position and vice versa, and that said ink soaking member is in contact with said periphery of said printing wheel at such time when said ink supplying device is located at said first position, and further that said ink soaking member is kept a distance away from said periphery of said printing wheel at such time when said ink supplying device is located at said second position; and wherein said main body has a base plate provided with a shaft and a slot contiguous to said shaft and having a longitudinal direction pointing at said shaft; wherein said printing wheel has an axial hole which is fitted over said shaft; and wherein a press member having an L-shaped construction is provided at one end thereof with two holding strips and a threaded rod, said press member further provided at another end thereof with a soft pad capable of being caused by said press member to face said periphery of said printing wheel, said two holding strips being attached to two sides of said shaft, said threaded rod being extended to an outside via said slot of said base plate to attach to said main body such that said threaded rod is capable of displacing along the direction of a longitudinal axis of said axial hole, said threaded rod having an outer end which is engaged with a rotary button for fastening securely said press member.

10. The tape dispenser as defined in claim 9, wherein said press member is fastened to said base plate such that said press member is capable of pressing a tape evenly on said printing plate of said printing wheel.

11. The tape dispenser as defined in claim 9, wherein said main body is composed of said base plate which is provided at one end thereof with a hand grip; and wherein said tape roll holding portion, said printing wheel, said ink supplying device and said tape cutter are fastened on said base plate.

12. The tape dispenser as defined in claim 9, wherein said printing plate of said printing wheel is provided therein with patterns or words.

* * * * *